United States Patent [19]

Schadov et al.

[11] Patent Number: 4,980,980

[45] Date of Patent: Jan. 1, 1991

[54] TOOTH FOR A DIGGING BUCKET OF AN EXCAVATOR

[76] Inventors: Mikhail I. Schadov, ulitsa Udaltsova, 24, kv.22, Moscow; Viktor M. Zhdamirov, ulitsa Ojunskogo, I, kv.4I, Yakutskaya Avtonomnaya SSR, Nerjungri; Konstantin E. Vinitsky, ulitsa D. Ulyanova, 4, korpus 2, kv.29I, Moscow; Evgeny E. Goldbukht, ulitsa Uralskaya, 6, korpus 7, kv.I4, Moscow; Alexandr V. Berman, Lomonosovsky prospekt, 23, kv.289, Moscow, all of U.S.S.R.

[21] Appl. No.: 348,496

[22] PCT Filed: Apr. 18, 1988

[86] PCT No.: PCT/SU88/00086

§ 371 Date: Apr. 7, 1989

§ 102(e) Date: Apr. 7, 1989

[87] PCT Pub. No.: WO89/01548

PCT Pub. Date: Feb. 23, 1989

[30] Foreign Application Priority Data

Aug. 11, 1987 [SU] U.S.S.R. ..... 4292058

[51] Int. Cl.[5] ..... E02F 9/28

[52] U.S. Cl. ..... 37/142 R; 37/141 T

[58] Field of Search ..... 37/141 R, 141 T, 142 R; 172/770, 771

[56] References Cited

U.S. PATENT DOCUMENTS

| | | | |
|---|---|---|---|
| 2,840,934 | 7/1958 | Hazzard et al. | 37/142 R |
| 3,959,901 | 6/1976 | Klett | 37/142 R |
| 4,117,611 | 10/1978 | Hemphill | 37/142 R |

FOREIGN PATENT DOCUMENTS

| | | | |
|---|---|---|---|
| 861511 | 9/1981 | U.S.S.R. | 37/141 T |
| 1146442 | 3/1985 | U.S.S.R. | 37/142 R |

OTHER PUBLICATIONS

Construction Methods, vol. 44, #10, p. 106, Oct. 1962, "3–Proven Hardfacing Methods . . . ".

*Primary Examiner*—Dennis L. Taylor
*Assistant Examiner*—Arlen L. Olsen
*Attorney, Agent, or Firm*—Burgess, Ryan & Wayne

[57] ABSTRACT

A tooth for a digging bucket of an excavator has a wedge-like profile formed by an end face (6) and two surfaces (4, 5) extending at an angle with respect to each other, one of which is undulated with at least two convex portions (8, 9) conjugated by a concave portion (11). The profile of the undulated surface (4) in the concave portion (11) is in the form of brachistochrone. A groove (7) is made in the end face (6) of the tooth to extend widthwise of the tooth.

5 Claims, 3 Drawing Sheets

TOOTH FOR A DIGGING BUCKET OF AN EXCAVATOR

TECHNICAL FIELD

The invention relates to earth moving machines such as excavators, and in particular, it deals with a tooth for a digging bucket of an excavator.

BACKGROUND OF THE INVENTION

A tooth of a digging bucket of an excavator is a working member which is subjected to an intensive abrasive wear during operation and to heavy impact and static loads which determine its service life. A tooth of an excavator bucket performs two main functions: it plunges into rock, it breaks-up the rock and guides the broken particles of rock into the excavator bucket. The construction of the excavator bucket tooth determines the character and magnitude of impact loads influencing reliablility of all assemblies and mechanisms of the excavator which, in the end of the day, determine productivity of the excavator. It should be also noted that replacement of worn or deformed teeth is a very tedious and time-consuming process. For example, it takes up to eight hours to replace a set of teeth of an excavator bucket having six-seven teeth, with the weight being each tooth of about 500 kg. Therefore, the problem of prolonging service life of teeth of an excavator digging bucket is a very important problem.

When a tooth of an excavator digging bucket plunges into the rock, a flow of particulate rock moves along its top surface, the flow of particulate rock at the starting portion of the tooth of a comparatively short length being of laminar nature. The flow of particulate rock then leaves the tooth surface which results in a material increase, from twenty to forty times, in resistance to penetration of the tooth in the rock. To lower this resistance, the portion of the tooth surface adjacent to the portion where the laminar flow of particulate rock leaves the tooth is made concave. The flow of particulate rock at this portion changes from laminar to turbulent so as to determine a positive formation of vortices in the boundary layer of particulate rock which is adjacent to the top surface of the tooth at the concave portions. The major part of coarser particulate rock moves over the vertices of the boundary layer. Therefore, intensity of abrasive wear of the tooth is determined by the character of movement of particulate rock in the boundary layer.

Known in the art is a tooth for a digging bucket of an excavator (U.S. Pat. No. 3,959,901) having a wedge-like profile defined by two surfaces extending at an angle with respect to each other. The top surface has two portions of an undulated configuration which are separated by a ridge.

The end of the tooth is pointed or has a comparatively small radius of curvature. The undulated shape of the top surface of the tooth lowers intensity of abrasive wear of the top surface of the tooth. However, the pointed end of the tooth plunges into the rock to break it with the formation of a large amount of dust particles and very fine particles of a size between 26 and 50 mm. Owing to a large amount of dust and fine particles of particulate rock which are in contact with the top surface of the tooth the intensity of its abrasive wear is rather high so as to substantially shorten service life of the tooth. It should also be noted that rock is broken down with substantial impact loads which also shorten service life of teeth of an excavator bucket.

Known in the art are teeth for excavator digging buckets having a groove in the end face widthwise of the tooth, which lowers impact loads acting upon the tooth when it breaks down the rock. The groove concentrates break down energy at a distance of about 0.237 m from the end face of the tooth in the rock body, and a dense core of dust particles is formed directly in front of the end face of the tooth which lowers impact loads owing to the deformation of this core and which initiates separation of a block of rock of about 0.237 m from the rock body.

It is known from the grading data that between 20 and 25% of the broken rock volume are in the form of particles of a size between 0.025 and 0.035 m and the content of dust particles is beteen 2 and 4%, the rest being coarser particles of 0.08 m and larger.

Known in the art is a tooth for a digging bucket of an excavator (U.S. Pat. No. 1,146,442) having a wedge-like profile defined by two surfaces extending at an angle with respect to each other, at least one surface being of an undulated configuration with at least two convex portions conjugated by a concave portion, the two surfaces being conjugated by an end face having a groove extending widthwise of the tooth. The top and back surfaces of the tooth are undulated. The profile of the undulated surfaces of the tooth is close to a sinusoid, and movement of the boundary layer formed by dust particles along the surface of the concave portions, on which movement of the boundary layer is turbulent, occurs with a slip so that the top surface of the tooth is subjected to an intensive abrasive wear. In addition, during slippage of the boundary layer on the pressure surges occur on the back surface so as to result in an increase in its wear.

SUMMARY OF THE INVENTION

It is an object of the present invention to provide a tooth for digging bucket of an excavator having such a form of an undulated surface defining the tooth profile that would provide movement of turbulent flow of dust particles of a boundary layer on its concave portions pratically without slip, and thereby ensuring reduced intensity of its abrasive wear.

This object is accomplished by a tooth of a digging bucket of an excavator having a wedge-like profile defined by two surfaces extending at an angle with respect to each other, wherein at least one surface is undulated with at least two convex portions conjugated by a concave portion and wherein the surfaces are conjugated by an end face in which there is a groove extending widthwise of the tooth, according to the invention, the profile of the undulated surface within at least the first concave portion behind the end face is configured as brachistrochrone.

It is expedient that in a tooth for a digging bucket of an excavator the profile of the undulated surface wtihin the first two convex portions behind the end face be configured as cycloid, with the radius of the generating circle of the cycloid being equal to the radius of the generating circle of the brachistochrone within the concave portion conjugated therewith, and an angle between the bases of the cycloids being between 100° and 120°.

It is preferred that the groove be conjugated with the first convex portion of the undulated surface behind the end face by a cylindrical surface, the radius of curvature of the cylindrical surface being equal to the radius of the generating circle of the brachistochrone of the first concave portion of the undulated surface behind the end face.

It is preferred that the radius of the generating circle of the brachistochrone of the concave portion be from 0.01 to 0.015 m.

It is preferred that the body of the tooth for a digging bucket of an excavator, in case there are at least three convex portions of the undulated surface, have a through hole, the axis of the hole running in parallel with the groove and being substantially equally spaced from the surfaces extending at an angle with respect to each other, opposite to the second concave portion of the undulated surface behind the end face, the radius of the hole equal to the radius of the generating circle of the brachistochrone of the concave portion of the undulated surface.

This configuration on the concave portions of the undulated surface of the tooth with the profile configured as brachistochrone ensures a descrease in intensity of abrasive wear of the tooth of a digging bucket of an excavator by at least twice since a body of revolution moves without slippage along brachistochrone. That is, rotating vortices of dust particles of the boundary layer move along the surface of the concave portions without slippage, and abrasive wear will occur substantially only under the action of rolling friction. It should also be noted that the boundary layer does not leave the tooth surface so as to protect it against contact with coarser particles of broken rock.

The provision of the profile of the convex portions of the undulated surface of the tooth for a digging bucket of an excavator in the form of cycloids the radii of the generating circle of the brachstochrone and an angle between the bases of which is between 100° and 120° ensures maximum length of the portion of the undulated surface within which movement of dust particles of the boundary layer is laminar. The transition between the convex and concave portions, the latter being in the form of brachistochrone, occurring exactly at a point of eventual separation of the laminar flow of particles which pratically rules out the separation of the boundary layer from the tooth surface owing to the change from laminar flow of boundary layer particles to turbulent flow.

Smooth conjugation of the surface of the groove with the undulated surface of the tooth ensures a continuous supply of dust particles forming in the boundary layer between the core and the end face of the tooth to this undulated surface so as to lower abrasive wear of the tooth as well.

As thickness of the boundary layer depends on the profile of the undulated surface of the tooth, namely on length and curvature of its convex and concave portions, with the radius of the generating circle of branchistochrone between 0.01 and 0.015 m, which determines curvature of brachistochrone, thickness of the boundary layer of dust particles will be approximately between 0.01 and 0.015 m. With this thickness of the boundary layer, coarser particles of broken rock between 25 and 35 mm in size which are located adjacent to the boundary layer and move therealong would not break down this layer, hence, they would not cause abrasive wear of the tooth surface.

The provision of a through hole in the tooth for a digging bucket of an excavator makes it possible to lower the force of penetration of the worn tooth of the digging bucket of the excavator into the rock to a maximum possible extent, thereby prolonging service life of the tooth because the hole surface functions as the groove.

BRIEF DESCRIPTION OF THE DRAWINGS

The invention will now be described in detail with reference to specific embodiments illustrated in the accompanying drawings, in which.

BEST MODE FOR CARRYING OUT THE INVENTION

Figure 1:
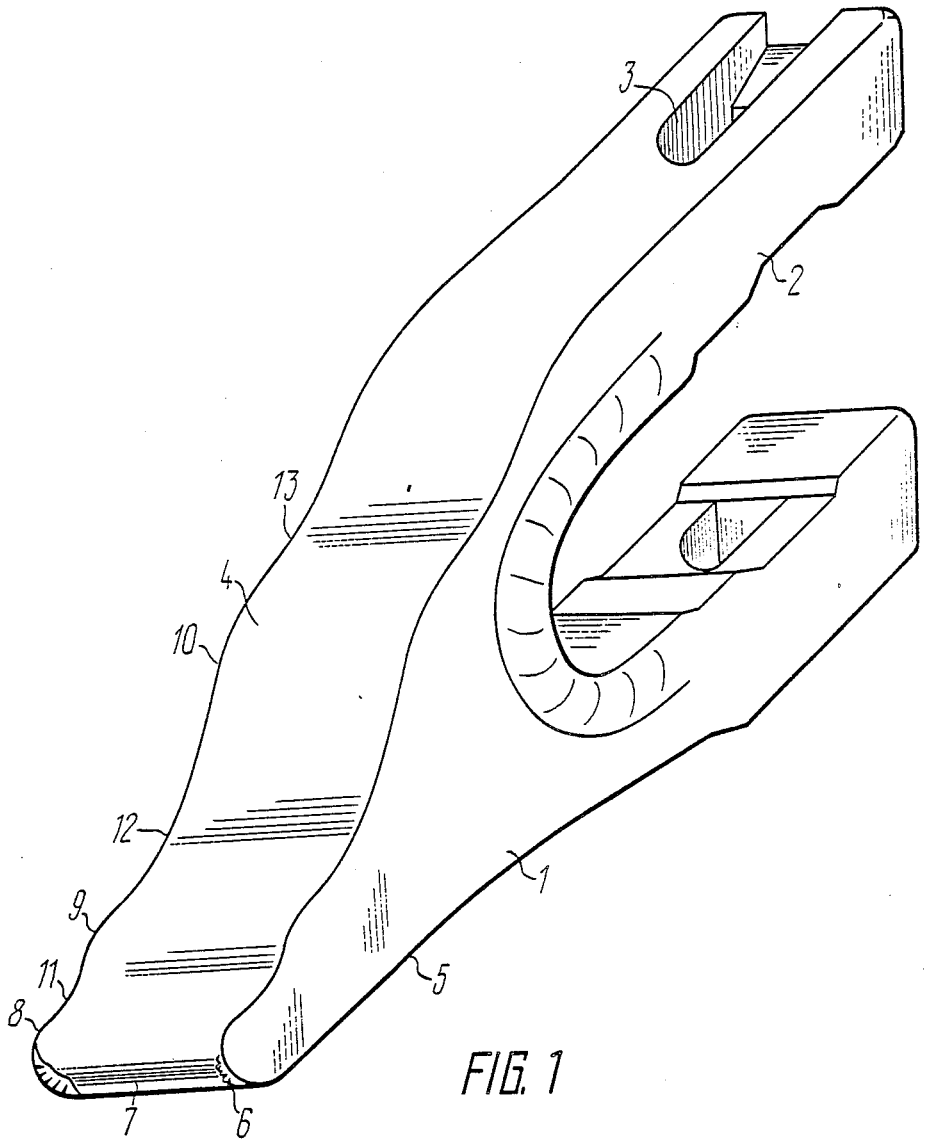
FIG. 1 is perspective view of a tooth for a digging bucket of an excavator, according to the invention.

A tooth for a digging bucket of an excavator has a body 1 (FIG. 1) and a shank 2 for attaching the tooth to a digging bucket jaw of an excavator (not shown in the drawing). The design of the shank 2 is determined by the design of the digging bucket or type of the excavator. In this embodiment, the tooth is designed for a single-bucket stripping excavator. The shank 2 has a horseshoe shape with holes 3 for receiving fasteners when the shank is attached to the bucket (not shown).

Figure 2:
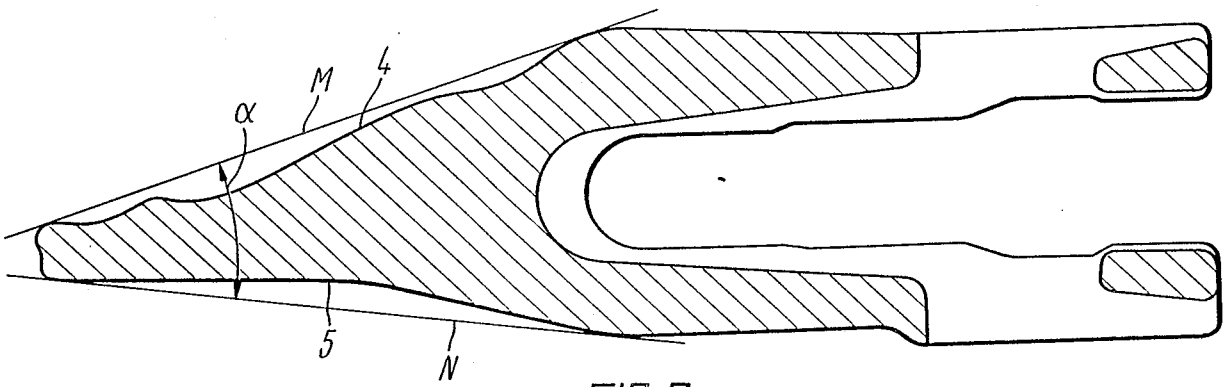
FIG. 2 is a longitudinal cross-sectional view of a tooth for a digging bucket of an excavator, according to the invention.

The tooth for a digging bucket of an excavator has a wedge-like profile which is defined by two surfaces extending at an angle with respect to each other: a top surface 4 and a back surface 5 which are conjugated by an end face 6. An angle $\alpha$ (FIG. 2) between tangents M and N to the top and back surfaces 4 and 5, respectively, should be about equal to the angle of friction of the rock being broken. This angle is generally between 27° and 35° for stripped rocks.

A groove 7 extending widthwise of the tooth is provided in the end face 6 (FIG. 1). Width of the teeth for a single-bucket stripping excavator in this embodiment is about 0.2 m.

At least one of the surfaces 4, 5 extending at an angle with respect to each other is undulated. In this embodiment shown in FIG. 1, the top surface 4 of the tooth is undulated.

The top undulated surface 4 of the tooth has at least two convex portions conjugated by a concave portion. In the embodiment of the tooth shown in FIG. 1, the top surface 4 has three convex portions 8, 9, 10 and three concave portions 11, 12, 13. This number of the convex portions may be between two and five and depends on the tooth size. The number of the concave portions of the same curvature may be maximum three. The adjacent convex portions 8, 9 conjugated by the concave portion 11 are of one and the same curvature, and curvature of the convex portion 10 is 3–4 times as great. The profile of the convex portions 8, 9, 10 may vary: it may be, e.g. sinusoidal, parabolic or hyperbolic. The profile of the concave portions 11, 12, 13 is in the form of brachistochrone so as to ensure movement of the boundary layer of dust particles therealong with their turbulent flow without slippage.

The back surface of the tooth for a digging bucket of an excavator in this embodiment is concave, with a large radius of curvature. For teeth of excavator buckets working in high hardness soils, it is preferred that the back surface be made undulated with concave portions having the profile in the form of brachistochrone.

Figure 3:
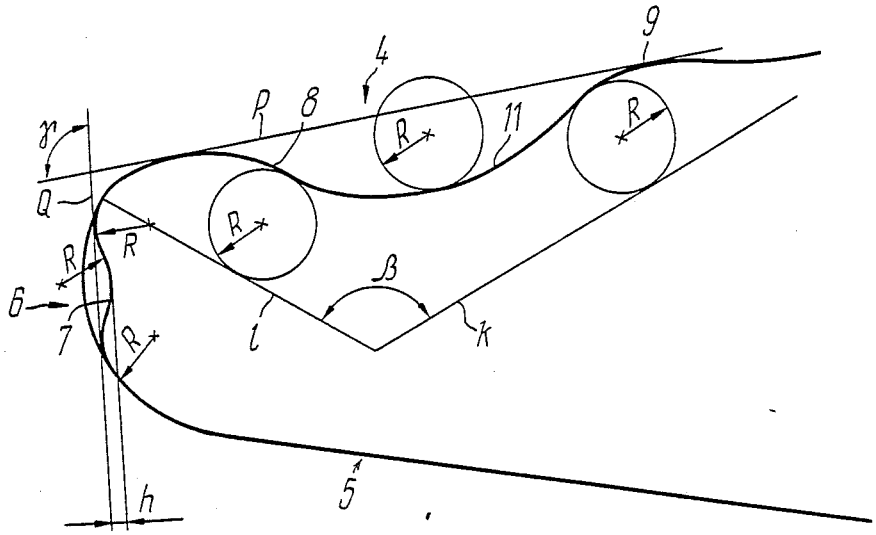
FIG. 3 shows an anlarged partial view of a tooth for a digging bucket of an excavator with two convex portions on the side of the end face, according to the invention.

In the embodiment of the tooth for a digging bucket of an excavator shown in FIG. 1, the profile of the undulated surface in the first two convex portions 8, 9 behind the end face 6 is in the form of cycloid, and the profile of the concave portion 11 therebetween is in the form of brachistochrone. Radii R (FIG. 3) of the generating circle of cycloid are equal to the radius R of the generating circle of brachistochrone. An angle $\beta$ between the bases l and k of the cycloids may be between 100° and 120°. In the embodiment shown in FIG. 3, this angle $\beta$ is equal to 120°. The value of angle $\beta$ depends on the angle of friction of the rock being broken. For rocks with a lower angle of friction angle $\beta$ may be lower. The profile of the groove 7 in the end face 6 is in the form of an arc of circle with a radius R equal to the radius of the generating circle of brachistochrone. Depth h of the groove 7 is between $\frac{1}{3}$ and $\frac{1}{4}$ times the diameter of the generating circle of the brachistochrone. The groove 7 is smoothly conjugated with the surface 4 of the tooth and with the back surface 5 of the tooth by cylindrical surfaces the radii R of curvature of which are equal to the radius R of the generating circle of the brachistochrone of the concave portion 11. The smooth conjugation of the top edge of the groove 7 with the convex portion 8 of the top surface 4 ensures continuous supply of dust particles from the boundary layer of the end face 6 to the top surface 4. An angle $\gamma$ between tangent P to the top surface 4 and tangent Q to the end face 6 is about 90° so as to lower wear of the lower edge of the groove 7.

The radius R of the generating circle of the brachistochrone of the concave portion 11 with which intensity of wear of the tooth for a digging bucket of an excavator is minimum and is between 0.01 and 0.015 m. It should be noted that the greater the angle of friction, the larger is the radius R of the generating circle of the brachistochrone. The radius R of the generating circle of the brachistochrone determines thickness of the boundary layer of dust particles which is about equal to this radius R. Thickness of this layer is chosen in such a manner that coarser particles of broken rock which move along the boundary layer to not disrupt its continuity and do not come in touch with the tooth surface. We have found by way of experiments that when the tooth is plunged into the rock body, a block of the rock is separated from the rock body which is of a length of about 0.237 m and which contains mainly coarse particles of a size of 0.08 m and greater and also fine and medium particles from 25 to 35 mm and a small amount of dust paticles - from 2 to 4%. Since fine and medium-size particles move over the boundary layer, thickness of the boundary layer within 0.01 to 0.015 m will reliably protect the tooth surface against contact with fine and medium-size particles so that its service life is prolonged.

Figure 4:
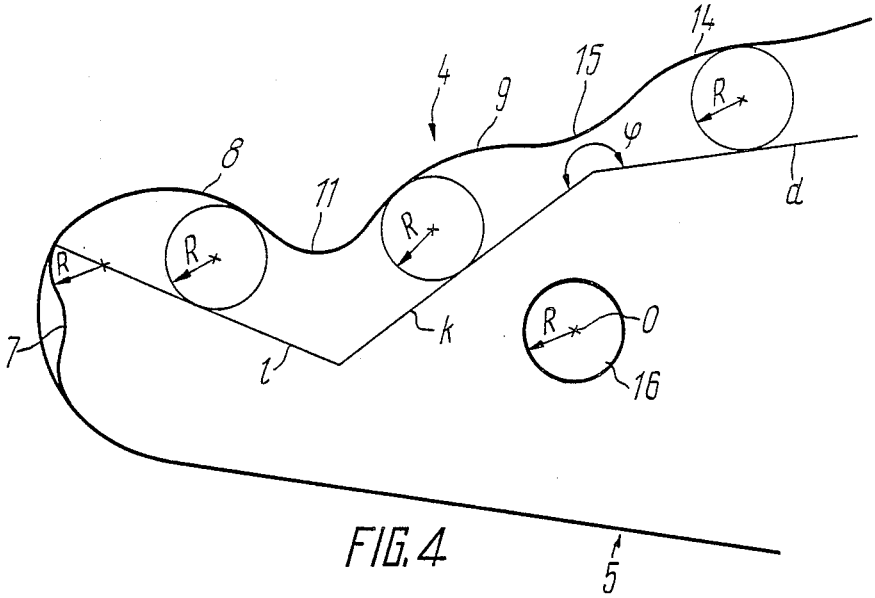
FIG. 4 shows an enlarged partial view of a tooth for a digging bucket of an excavator with three convex portions and a through hole, according to the invention.

To prolong service life of the tooth for a digging bucket of an excavator in the embodiment shown in FIG. 4, its top surface 4 has one more third convex portion 14 which is conjugated with the convex portion 9 by a concave portion 15 in the form of brachistochrone with the radius R of the generating circle. The convex portion 14 is in the form of cycloid with the radius R of its generating circle which is equal to the radius R of the generating circle of the brachistochrone in the concave portions 11 and 15. An angle $\phi$ between the base d of this cycloid and the base k of the cycloid of the convex portion 9 is 210°. A through hole 16 is made in the tooth for a digging bucket of an excavator which about equally spaced from its top and back surfaces 4 and 5, opposite to the second portion 15, the axis 0 of the hole running in parallel with the groove 7. The radius R of the hole 16 is equal to the radius R of the generating circle of brachistochrone of the concave portions 11 and 15 and is between 0.01 and 0.015 m.

The tooth for a digging bucket of an excavator, according to the invention, functions in the following manner. When the tooth of the excavator bucket is plunged deep into rock with a force of between 2.7 and 9 tf, at least three zones of three-dimensional stressed state are formed in the rock body in front of the end face 6 (FIG. 1) along the width of the tooth which is equal to about 0.2 m, in which cracks are formed at a distance of about 0.237 m. A compacted core of dust particles is formed in each zone directly in front of the groove 7 which rotates to initiate the formation of cracks along the surface of each of the zones of three-dimensional stressed state which blend to cause separation of particulate rock within these zones from the rock body. During further movement of the tooth within the broken rock body until it comes in contact with the intact rock, the broken particles are moved along its top surface into the bucket (not shown in the drawings). The broken rock contains dust particles, fine and medium-size particles ranging in size from 0.025 to 0.035 m and coarse particles of a size greater than 0.035 m.

The dust particles form a boundary layer which is in contact with, and move directly along the top surface 4 of the tooth of the excavator bucket.

The dust particles which are formed directly in front of the groove 7 move from the groove 7 in the form of a laminar flow towards the convex portion 8 and then, from the convex portion 8, they move to the concave portion 11 on which the flow of the dust particles of the boundary layer changes to turbulent. The profile of the concave portion 11 which is in the form of brachistochrone ensures movement of the vortices without slippage so as to lower intensity of abrasive wear of the concave portion 11 and the upper and back portions 4 and 5 of the tooth of the excavator bucket. Subsequently, the turbulent flow of dust paticles of the boundary layer approaches the convex portion 9 where it changes to laminar with a velocity which is higher than velocity of laminar flow on the convex portion 8 so as to increase the rotation velocity in the turbulent flow of dust particles of the boundary layer on the concave portion 12. When dust particles move along the convex and concave portions 8, 11, 9; 12, 10, 13 of the top surface 4, the boundary layer does not leave the top surface 4 of the tooth. Intensity of wear of this top surface 4 is low and is practically identical wtih both laminar and turbulent flow of the boundary layer.

As movement of the boundary layer along the top suface 4 of the tooth occurs without separation, there are no pressure surges on the back surface 5 of the tooth so as to lower wear of the back surface 5 of the tooth.

Fine and medium-size particles of a size from 0.025 to 0.035 m move over the boundary layer. Since the profile of the concave portion 11, 12, 13 is in the form of brachistochrone with the radius of the generating circle R between 0.01 and 0.015 m and thickness of the boundary layer on this portions 11, 12, 13 is between 0.01 and 0.015 m, fine and medium-size particles do not disrupt continuity of the boundary layer and move over this layer without coming in contact with the top surface 4 of the tooth so as to lower intensity of wear of the tooth and prolong its service life. The tooth for a digging bucket of an axcavator, according to the invention, makes it possible to prolong service life of a set of seven teeth for a single-bucket excavator at least up to 1.7 mln. $m^3$ of stripping work.

The embodiment of the tooth for a digging bucket of an excavator shown in FIG. 4 makes it possible to prolong service life of the tooth by at least 20% since with complete wear of the end face of the tooth up to its hole 16 the surface of this hole will allow the force of penetration of the worn tooth into the rock to the lowered. Therefore, the surface of the hole 16 will form, during the plunge of the worn tooth into the rock, zones of three-dimensional stressed state in the rock body which are similar to the zones forming in front of the goove 7. We have found by experiments that service life of a set of seven teeth for a digging bucket of an excavator amounted to 2.2 mln. $m^3$ of stripping work.

INDUSTRIAL APPLICABILITY

A tooth for a digging bucket of an excavator, according to the invention, may be used in both single-bucket and wheel-type excavators which are used for working mineral deposits preferably by the open-pit mining. It can also be used in road building and stripping excavators.

We claim:

1. A tooth of a digging bucket of an excavator having a wedge-like profile defined by two surfaces extending at an angle with respect to each other from an end face having a widthwise groove therein, wherein at least one surface is undulated and comprises at least two convex portions conjugated by a concave portion wherein a first concave surface behind the end face is shaped as a brachistochrone means for preventing separation of the boundary layer.

2. The tooth of claim 1, wherein the profile of the undulated surface within the first two convex portions behind the end face are shaped as a cycloid having opposed bases, said cycloid having a radius and equal to a radius of the generating circle of the brachistochrone means wherein an angle between the bases of the cycloids is between 100° and 120°.

3. The tooth of claim 2, wherein the groove is conjugated with one of the two convex portions of the undulated surface behind the end face by a cylindrical surface having a radius of curvature equal to the radius of the generating circle of the brachisochrone means.

4. The tooth of claim 2 or 3, wherein the radius of the generating circle of the brachistochrone is from 0.01 to 0.015 m means.

5. The tooth of claim 4, comprising at least three convex portions and a second concave portion behind the end face, and a through hole having an axis parallel with the groove and substantially equally spaced from the two surfaces and opposite to the second concave portion, wherein the radius of the hole is equal to the radius of the generating circle of the brachistochrone.

* * * * *